United States Patent [19]

Otsuka et al.

[11] 4,401,080

[45] Aug. 30, 1983

[54] AIR/FUEL RATIO CONTROL SYSTEM FOR INTERNAL COMBUSTION ENGINES, HAVING AIR/FUEL RATIO CONTROL FUNCTION AT ENGINE ACCELERATION

[75] Inventors: Kazuo Otsuka, Higashikurume; Shin Narasaka, Yono; Shumpei Hasegawa, Niiza, all of Japan

[73] Assignee: Honda Giken Kogyo Kabushiki Kaisha, Tokyo, Japan

[21] Appl. No.: 285,310

[22] Filed: Jul. 20, 1981

[30] Foreign Application Priority Data

Jul. 25, 1980 [JP] Japan ..... 55-102796

[51] Int. Cl.[3] ..... F02B 3/00

[52] U.S. Cl. ..... 123/440; 123/489; 123/492

[58] Field of Search ..... 123/440, 489, 492

[56] References Cited

U.S. PATENT DOCUMENTS

| | | | |
|---|---|---|---|
| 4,111,170 | 9/1978 | Nakajima et al. | 123/440 |
| 4,144,847 | 3/1979 | Hosaka | 123/440 |
| 4,174,689 | 11/1979 | Hosaka | 123/440 |
| 4,292,945 | 10/1981 | Kiesling | 123/440 |
| 4,337,746 | 7/1982 | Masaki | 123/440 |
| 4,344,400 | 8/1982 | Asano | 123/440 |

*Primary Examiner*—Parshotam S. Lall
*Attorney, Agent, or Firm*—Lyon & Lyon

[57] ABSTRACT

An air/fuel ratio control system for use with an internal combustion engine, in which an acceleration detecting circuit produces a signal indicative of engine acceleration when the engine rpm increases across a predetermined value which is slightly higher than an idle rpm to which the engine is adjusted, and driving pulse supply means is responsive to this acceleration signal to supply driving pulses to a pulse motor to cause it to move the valve position of an air/fuel ratio control valve to a preset position whereby improved exhaust gas emission characteristics of the engine can be obtained at the standing start of the engine and during subsequent normal operation thereof.

3 Claims, 4 Drawing Figures

1
2
3
4
5
6
7₁
7₂
8₁
8₂
8₃
8₄
9
10
10a
11
11a
12
13
14
15
16
17
18
20
21
22
23
24
25
26
27
28
28a
29
29a
29b
30
31
32
33
34
35
36
37
38
39
40
41

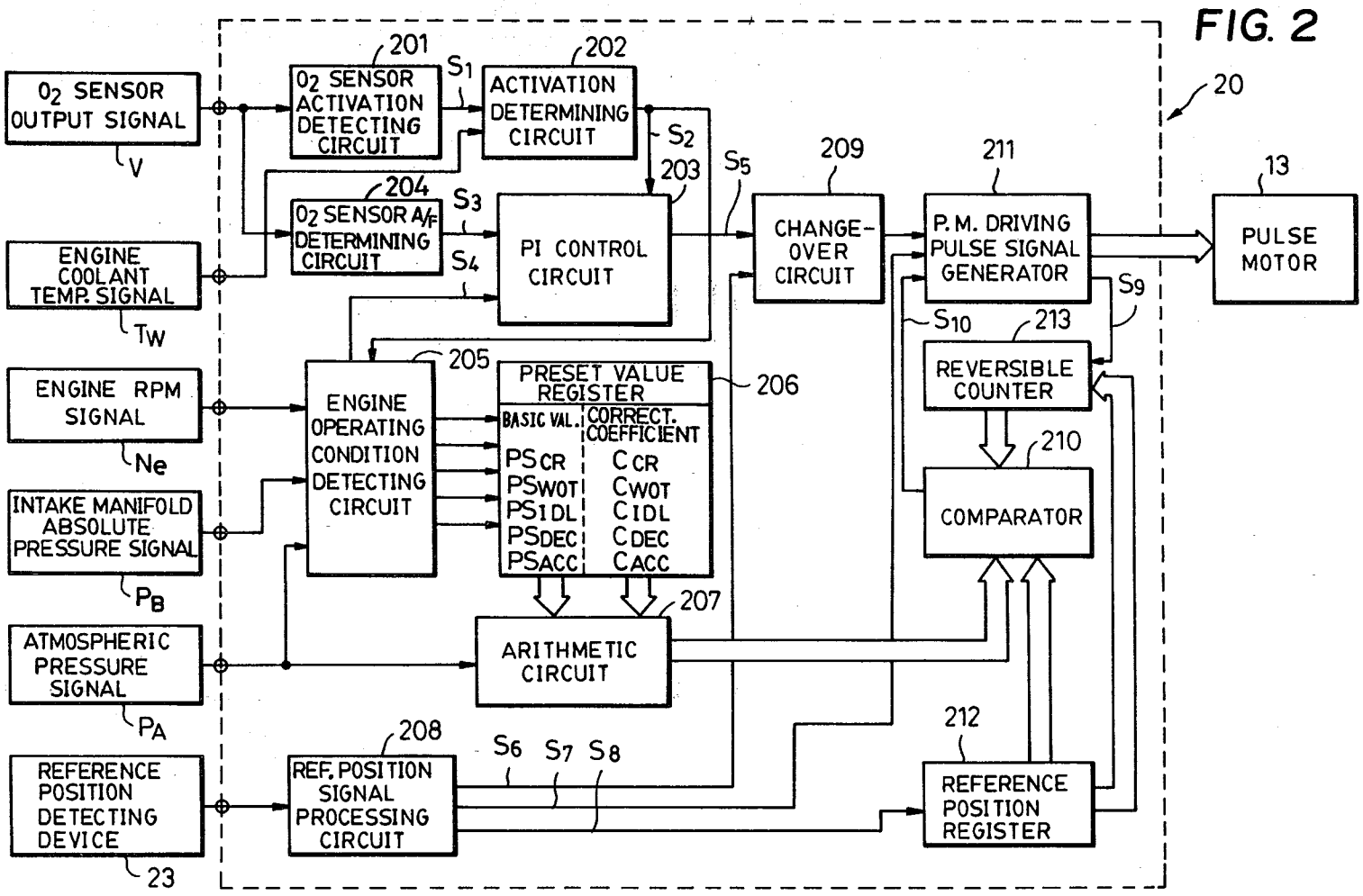
FIG. 2
20
13
PULSE MOTOR
211
P. M. DRIVING PULSE SIGNAL GENERATOR
S9
S10
213
REVERSIBLE COUNTER
210
COMPARATOR
212
REFERENCE POSITION REGISTER
209
CHANGE-OVER CIRCUIT
S5
206
S2
203
PI CONTROL CIRCUIT
PRESET VALUE REGISTER
BASIC VAL.
CORRECT. COEFFICIENT
PSCR
PSWOT
PSIDL
PSDEC
PSACC
CCR
CWOT
CIDL
CDEC
CACC
207
ARITHMETIC CIRCUIT
S8
S7
S6
202
ACTIVATION DETERMINING CIRCUIT
S1
S3
S4
205
201
O2 SENSOR ACTIVATION DETECTING CIRCUIT
204
O2 SENSOR A/F DETERMINING CIRCUIT
ENGINE OPERATING CONDITION DETECTING CIRCUIT
208
REF. POSITION SIGNAL PROCESSING CIRCUIT
O2 SENSOR OUTPUT SIGNAL
V
ENGINE COOLANT TEMP. SIGNAL
TW
ENGINE RPM SIGNAL
Ne
INTAKE MANIFOLD ABSOLUTE PRESSURE SIGNAL
PB
ATMOSPHERIC PRESSURE SIGNAL
PA
REFERENCE POSITION DETECTING DEVICE
23

AIR/FUEL RATIO CONTROL SYSTEM FOR INTERNAL COMBUSTION ENGINES, HAVING AIR/FUEL RATIO CONTROL FUNCTION AT ENGINE ACCELERATION

BACKGROUND OF THE INVENTION

This invention relates to an air/fuel ratio control system for controlling the air/fuel ratio of an air/fuel mixture being supplied to an internal combustion engine, and more particularly to an acceleration control device provided in such control system, for performing air/fuel ratio control in a predetermined manner when the engine is accelerated from its idle state.

An air/fuel ratio control system has already been proposed, e.g., by the assignee of the present application, which is arranged to perform feedback control of the air/fuel ratio of an air/fuel mixture being supplied to an internal combustion engine having an exhaust system provided with a three-way catalyst, which comprises means for detecting the concentration of an ingredient in the engine exhaust gases, fuel quantity adjusting means for producing the mixture being supplied to the engine, and means operatively connecting the concentration detecting means with the fuel quantity adjusting means in a manner effecting feedback control operation in response to an output signal produced by the concentration detecting means to control the air/fuel ratio of the mixture to a preset value, the connecting means including a valve for varying the air/fuel ratio of the mixture being supplied to the engine, a pulse motor for driving the valve, and an electrical circuit arranged to drive the pulse motor in response to the output signal of the concentration detecting means. The air/fuel ratio control system is thus capable of achieving improved engine driveability as well as improved engine exhaust gas emission characteristics.

The operating states of an internal combustion engine where detrimental gases are contained in large quantities in the exhaust gases under normal operating conditions of a vehicle on which the engine is installed, include the so-called "standing start" which means starting the vehicle from its standing position. That is, when the accelerator pedal of the vehicle is stepped on to accelerate the engine from its idle state, the mixture being supplied to the engine becomes too rich due to the action of an acceleration pump mounted on the engine. This causes an increase in the amount of unburnt ingredients in the exhaust gases. Further, on this occasion, the suction air amount increases due to wide opening of the throttle valve to increase the charging efficiency of the engine so that the combustion temperature rises, which results in an increase in the amount of NOx present in the exhaust gases.

According to the aforementioned proposed air/fuel ratio control system, there is a response lag between the time of the standing start and the time of the engine shifting into a normal operating condition if the air/fuel ratio feedback control is conducted on the basis of detection of the concentration of an engine exhaust gas ingredient, which makes it impossible to achieve accurate air/fuel ratio in quick response to sudden acceleration at the standing start of the vehicle. As a result, a required air/fuel ratio cannot be achieved at the start of normal operation of the engine under air/fuel ratio feedback control immediately after the standing start of the vehicle, thus deteriorating the exhaust gas emission characteristics of the engine. More specifically, in addition to emission of a large amount of detrimental gas ingredients at the standing start of the vehicle, there is also the occurrence of detrimental gas ingredients in large quantities at normal operation of the engine immediately after the standing start, which leads to a great increase in the total amount of detrimental gas ingredients or pollutants in the exhaust gases from the standing start to the subsequent normal operation.

OBJECT AND SUMMARY OF THE INVENTION

It is therefore the object of the invention to provide an air/fuel ratio control system for use with an internal combustion engine, which is provided with such a novel function of air/fuel ratio control applicable at engine acceleration that the pulse motor for driving the air/fuel ratio control valve is moved to a predetermined position at the standing start of the vehicle, and hence the system carries out air/fuel ratio control during operation following the standing start, with the above predetermined pulse motor position as the starting point of initiation of the feedback control. With the above function, the system is capable of keeping to a suitable small value the amount of detrimental gas ingredients to be emitted at normal operation immediately following the standing start as well as at the standing start, so as to obtain best exhaust gas emission characteristics at the normal operation, to thereby achieve a reduction in the total amount of detrimental exhaust gas ingredients emitted throughout the standing start and the normal operation.

According to the invention, there is provided an air/fuel ratio control system for performing feedback control of the air/fuel ratio of an air/fuel mixture being supplied to an internal combustion engine, which includes means for detecting the concentration of an exhaust gas ingredient emitted from the engine, fuel quantity adjusting means for producing the mixture being supplied to the engine, and means operatively connecting the concentration detecting means with the fuel quantity adjusting means in a manner effecting feedback control operation in response to an output signal produced by the concentration detecting means to control the air/fuel ratio of the mixture to a preset value, the connecting means including a valve for varying the air/fuel ratio of the mixture being supplied to the engine, a pulse motor for driving the valve, and an electrical circuit for driving the pulse motor in response of the output signal of the concentration detecting means. The system is characterized by comprising in combination means for detecting an actual engine rpm, an acceleration detecting circuit connected to the engine rpm detecting means for producing a signal indicative of engine acceleration when the engine rpm detected by the engine rpm detected means increases across a predetermined value which is slightly higher than an idle rpm to which the engine is adjusted, and means responsive to the acceleration signal to supply driving pulses to the pulse motor so as to cause it to drive the above valve to a preset valve position. The acceleration detecting means and the driving pulse supply means form part of the above electrical circuit.

The above and other objects, features, and advantages of the invention will be more apparent from the ensuing detailed description taken in connection with the accompanying drawings in which:

BRIEF DESCRIPTION OF THE DRAWINGS

FIG. 2 is a block diagram illustrating the whole arrangement of an electrical circuit provided in an electronic control unit (ECU) in FIG. 1 for carrying out the air/fuel ratio control according to the invention.

DETAILED DESCRIPTION

The air/fuel ratio control system according to the invention will now be described in detail with reference to the accompanying drawings wherein an embodiment of the invention is illustrated.

Figure 1:
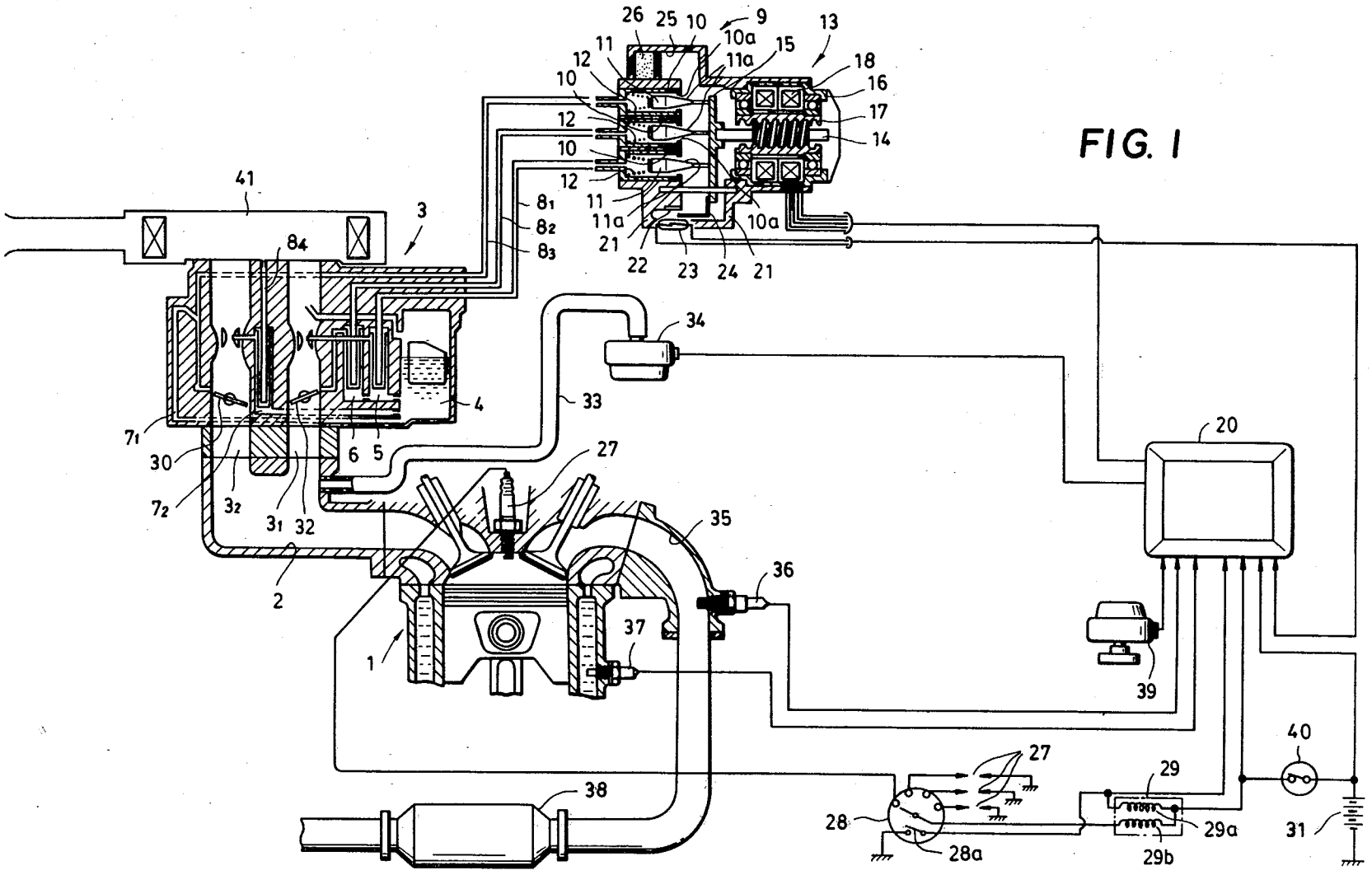
FIG. 1 is a diagrammatic view illustrating the whole arrangement of the air/fuel ratio control system according to an embodiment of the present invention.

Referring now to FIG. 1, there is illustrated the whole system of the invention. Reference numeral 1 designates an internal combustion engine. Connected to the engine 1 is an intake manifold 2 which is provided with a carburetor generally designated by the numeral 3. The carburetor 3 has fuel passages 5, 6 which communicate a float chamber 4 with the primary bore $3_1$ of the carburetor 3. These fuel passages 5, 6 are connected to an air/fuel ratio control valve generally designated by the numeral 9, via air bleed passages $8_1$, $8_2$. The carburetor 3 also has fuel passages $7_1$, $7_2$ communicating the float chamber 4 with the secondary bore $3_2$ of the carburetor 3. The fuel passage $7_1$, on one hand, is connected to the above air/fuel ratio control valve 9 via an air passage $8_3$ and, on the other hand, opens in the secondary bore at a location slightly upstream of a throttle valve 30 in the secondary bore. The fuel passage $7_2$ communicates with the interior of an air cleaner 41 via an air passage $8_4$ having a fixed orifice. The control valve 9 is comprised of three flow rate control valves, each of which is formed of a cylinder 10, a valve body 11 displaceably inserted into the cylinder 10, and a coil spring 12 interposed between the cylinder 10 and the valve body 11 for urging the valve body 11 in a predetermined direction. Each valve body 11 is tapered along its end portion 11*a* remote from the coil spring 12 so that the effective opening area of the opening 10*a* of each cylinder 10, in which the tapered portion 11*a* of the valve body is inserted, varies as the valve body 11 is moved. Each valve body 11 is disposed in urging contact with a connection plate 15 coupled to a worm element 14 which is axially movable but not rotatable about its own axis. The worm element 14 is in threaded engagement with the rotor 17 of a pulse motor 13 which is arranged about the element 14 and rotatably supported by radial bearings 16. Arranged about the rotor 17 is a solenoid 18 which is electrically connected to an electronic control unit (hereinafter called "ECU") 20. The solenoid 18 is energized by driving pulses supplied from ECU 20 to cause rotation of the rotor 17 which in turn causes movement of the worm element 14 threadedly engaging the rotor 17 in the leftward and rightward directions as viewed in FIG. 1. Accordingly, the connection plate 15 coupled to the worm element 14 is moved leftward and rightward in unison with the movement of the worm element 14.

The pulse motor 13 has its stationary housing 21 provided with a permanent magnet 22 and a reed switch 23 arranged opposite to each other. The plate 15 is provided at its peripheral edge with a magnetic shielding plate 24 formed of a magnetic material which is interposed between the permanent magnet 22 and the reed switch 23 for movement into and out of the gap between the two members 22, 23. The magnetic shielding plate 24 is displaced in the leftward and rightward directions in unison with displacement of the plate 15 in the corresponding directions. The reed switch 23 turns on or off in response to the displacement of the plate 24. That is, when the valve body 11 of the air/fuel ratio control valve 9 passes a reference position which is determined by the positions of the permanent magnet 22, reed switch 23 and magnetic shielding plate 24, the reed switch 23 turns on or off depending upon the moving direction of the valve body 11, to supply a corresponding binary output signal to ECU 20.

Incidentally, the pulse motor housing 21 is formed with an air intake 25 communicating with the atmosphere. Air is introduced through a filter 26 mounted in the air intake 25, into each flow rate control valve in the housing 21.

On the other hand, an ignition plug 27 is embedded in the head of a cylinder of the engine 1, with its tip projecting in the combustion chamber in the cylinder. This ignition plug 27 is electrically connected to a distributor 28 as one of a plurality of such ignition plugs each provided in a plurality of engine cylinders. Connected to the distributor 28 are ignition coil 29 which are in turn connected to a car battery 31 by way of an ignition switch 40. In the illustrated embodiment, the ignition switch 40 and the car battery 31 are also used as the power switch of ECU 20 and the power supply therefor, respectively. The above distributor 28 is coupled to the camshaft, not shown, of the engine for rotation at a speed proportional to the speed of the engine to cause intermittent supply of current to the primary coil 29*a* of the ignition coil 29 to energize same in response in frequency to interrupting action of its contact breaker 28*a* or an alternative contactless pickup so that high voltage current is distributed to the ignition plug 27 of each engine cylinder, which is produced in the secondary coil 29*b* of the coil 29 correspondingly to the intermittent deenergization of the primary coil 29*a*. The contact breaker 28*a* and the primary coil 29*a* are connected to ECU 20 so that intermittent current flowing through the primary coil 29*a* caused by the interrupting action of the contact breaker 28*a* is supplied to ECU 20. Thus, the distributor 28 and the ignition coil 29 also serve as an engine rpm sensor.

A pressure sensor 34 is connected to the interior of the intake manifold 2 communicating with the engine 1, by means of a conduit 33 having its one end opening in the manifold 2 at a location downstream of the throttle valves 30, 32, to detect absolute pressure in the intake manifold 2. This pressure sensor 34 has its output electrically connected to ECU 20 to supply its output signal indicative of the detected absolute pressure thereto.

An $O_2$ sensor 36, which is made of stabilized zirconium oxide or the like, is mounted in a partly projecting manner at an exhaust manifold 35 communicating with the engine 1 to detect the concentration of oxygen present in the exhaust gases emitted from the engine. The $O_2$ sensor 36 has its output electrically connected to ECU 20, too, to supply its output signal thereto.

Incidentally, in FIG. 1, reference numeral 37 designates a thermistor partly inserted in the peripheral wall of the engine cylinder the interior of which is filled with cooling water to detect the temperature of the water as engine temperature, an output signal of which is also supplied to ECU 20. Reference numeral 38 denotes a three-way catalyst arranged in the exhaust manifold 35 to purify the ingredients HC, CO, NOx in the exhaust gases, and 39 an atmospheric pressure sensor, respectively.

Details of the air/fuel ratio control which can be performed by the air/fuel ratio control system according to the invention will now be described by further reference to FIG. 1 which has been referred to hereinabove.

INITIALIZATION

Referring first to the initialization, when the ignition switch 40 in FIG. 1 is turned on, ECU 20 is initialized to detect the reference position of the actuator or pulse motor 13 by means of the reed switch 23 and hence drive the pulse motor 13 to set it to its best position (a preset position) for starting the engine, that is, set the initial air/fuel ratio to a predetermined proper value. The above preset position of the pulse motor 13 is hereinafter called "$PS_{CR}$." This setting of the initial air/fuel ratio is made on condition that the engine rpm Ne is lower than a predetermined value $N_{CR}$ (e.g., 400 rpm) and the engine is in a condition before firing. The predetermined value $N_{CR}$ is set at a value higher than the cranking rpm and lower than the idling rpm.

The above reference position of the pulse motor 13 is detected as the position at which the reed switch 23 turns on or off, as previously mentioned with reference to FIG. 1.

Then, ECU 20 monitors the condition of activation of the $O_2$ sensor 36 and the coolant temperature Tw detected by the thermistor 37 to determine whether or not the engine is in a condition for initiation of the air/fuel ratio control. For accurate air/fuel ratio feedback control, it is a requisite that the $O_2$ sensor 36 is fully activated and the engine is in a warmed-up condition. The $O_2$ sensor, which is made of stabilized zirconium dioxide or the like as previously mentioned, has a characteristic that its internal resistance decreases as its temperature increases. If the $O_2$ sensor is supplied with electric current through a resistance having a suitable resistance value from a constant-voltage regulated power supply provided within ECU 20, the electrical potential or output voltage of the sensor initially shows a value close to the power supply voltage (e.g., 5 volts) when the sensor is not activated, and then, its electrical potential lowers with the increase of its temperature. Therefore, according to the invention, the air/fuel ratio feedback control is not initiated until after the conditions are fulfilled that the sensor produces an activation signal when its output voltage lowers down to a predetermined voltage Vx (e.g., 0.5 volt), a timer finishes counting for a predetermined period of time $t_x$ (e.g., 1 minute) starting from the occurrence of the above activation signal, and the coolant temperature Tw increases up to a predetermined value Twx at which the automatic choke is opened to an opening for enabling the air/fuel ratio feedback control.

During the above stage of the detection of activation of the $O_2$ sensor and the coolant temperature Tw, the pulse motor 13 is held at its predetermined position $PS_{CR}$. The pulse motor 13 is driven to appropriate positions in response to the operating condition of the engine after initiation of the air/fuel ratio control, as hereinlater described.

BASIC AIR/FUEL RATIO CONTROL

Following the initialization, the program proceeds to the basic air/fuel ratio control.

ECU 20 is responsive to various detected value signals representing the output voltage of the $O_2$ sensor 36, the absolute pressure in the intake manifold 2 detected by the pressure sensor 34, the engine rpm Ne detected by the rpm sensor 28, 29, and the atmospheric pressure $P_A$ detected by the atmospheric pressure sensor 39, to drive the pulse motor 13 as a function of the values of these signals to control the air/fuel ratio. More specifically, the basic air/fuel ratio control comprises open loop control which is carried out at wide-open-throttle, at engine idle, and at engine deceleration, and closed loop control which is carried out at engine partial load. All the control is initiated after completion of the warming-up of the engine.

First, the condition of open loop control at wide-open-throttle is met when the differential pressure $P_A - P_B$ (gauge pressure) between the absolute pressure $P_B$ detected by the pressure sensor 34 and the atmospheric pressure $P_A$ (absolute pressure) detected by the atmospheric pressure sensor 39 is lower than a predetermined value $\Delta P_{WOT}$. ECU 20 compares the difference in value between the output signals of the sensors 34, 39 with the predetermined value $\Delta P_{WOT}$ stored therein, and when the relationship of $P_A - P_B < \Delta P_{WOT}$ stands, drives the pulse motor 13 to a predetermined position (preset position) $PS_{WOT}$ and holds it there, which is a position best appropriate for the engine emissions to be obtained at the time of termination of the wide-open-throttle open loop control. At wide-open-throttle, a known economizer, not shown, or the like is actuated to supply a rich or small air/fuel ratio mixture to the engine.

The condition of open loop control at engine idle is met when the engine rpm Ne is lower than a predetermined idle rpm $N_{IDL}$ (e.g., 1,000 rpm). ECU 20 compares the output signal value Ne of the rpm sensor 28, 29 with the predetermined rpm $N_{IDL}$ stored therein, and when the relationship of $Ne < N_{IDL}$ stands, drives the pulse motor 13 to a predetermined idle position (preset position) $PS_{IDL}$ which is best suitable for the engine emissions and holds it there.

The above predetermined idle rpm $N_{IDL}$ is set at a value slightly higher than the actual idle rpm to which the engine concerned is adjusted.

The condition of open loop control at engine deceleration is fulfilled when the absolute pressure $P_B$ in the intake manifold is lower than a predetermined value $PB_{DEC}$. ECU 20 compares the output signal value $P_B$ of the pressure sensor 34 with the predetermined value $PB_{DEC}$ stored therein, and when the relationship of $P_B < PB_{DEC}$ stands, drives the pulse motor 13 to a predetermined deceleration position (preset position) $PS_{DEC}$ best suitable for the engine emissions and holds it there.

The ground for this condition of open loop control at engine deceleration lies in that when the absolute pressure $P_B$ in the intake manifold drops below the predetermined value, unburned HC is produced at an increased rate in the exhaust gases, to make it impossible to carry out the air/fuel ratio feedback control based upon the detected value signal of the $O_2$ sensor with accuracy, thus failing to control the air/fuel ratio to a theoretical value. Therefore, according to the invention, the open loop control is employed, as noted above, when the absolute pressure $P_B$ in the intake manifold detected by the pressure sensor 34 is smaller than the predetermined value $PB_{DEC}$, where the pulse motor is set to the predetermined position $PS_{DEC}$ best suitable for the engine emissions obtained at the time of termination of the deceleration open loop control.

During operations of the above-mentioned open loop control at wide-open-throttle, at engine idle, at engine deceleration, the respective predetermined positions $PS_{WOT}$, $PS_{IDL}$, $PS_{DEC}$ for the pulse motor 13 are compensated for atmospheric pressure $P_A$, as hereinlater described.

On the other hand, the condition of closed loop control at engine partial load is met when the engine is in an operating condition other than the above-mentioned open loop control conditions. During the closed loop control, ECU 20 performs selectively feedback control based upon proportional term correction (hereinafter called "P term control") and feedback control based upon integral term correction (hereinafter called "I term control"), in response to the engine rpm Ne detected by the engine rpm sensor 28, 29 and the output signal of the $O_2$ sensor 36. To be definite, the integral term correction is used when the output voltage of the $O_2$ sensor 36 varies only at the higher level side or only at the lower level side with respect to a reference voltage Vref, wherein the position of the pulse motor 13 is corrected by an integral value obtained by integrating the value of a binary signal which changes in dependence on whether the output voltage of the $O_2$ sensor is at the higher level or at the lower level with respect to the predetermined reference voltage Vref, to thereby achieve stable and accurate position control of the pulse motor 13. On the other hand, when the output signal of the $O_2$ sensor changes from the higher level to the lower level or vice versa, the proportional term correction is carried out wherein the position of the pulse motor 13 is corrected by a value directly proportional to a change in the output voltage of the $O_2$ sensor to thereby achieve air/fuel ratio control in a manner prompter and more efficient than the integral term correction.

As noted above, according to the above I term control, the pulse motor position is varied by an integral value by integrating the value of a binary signal corresponding to the change of the output voltage of the $O_2$ sensor. According to this I term control, the number of steps by which the pulse motor is to be displaced per second differs depending upon the speed at which the engine is then operating. That is, in a low engine rpm range, the number of steps by which the pulse motor is to be displaced is small. With an increase in the engine rpm, the above number of steps increases so that it is large in a high engine rpm range.

Whilst, according to the P term control which, as noted above, is used when there is a change in the output voltage of the $O_2$ sensor from the higher level to the lower one or vice versa with respect to the reference voltage Vref, the number of steps by which the pulse motor is to be displaced per second is set at a single predetermined value (e.g., 6 steps), irrespective of the engine rpm.

The air/fuel ratio control at engine acceleration (i.e., off-idle acceleration) is carried out when the engine rpm Ne exceeds the aforementioned predetermined idle rpm $N_{IDL}$ during the course of the engine speed increasing from a low rpm range to a high rpm range, that is, when the engine speed changes from a relationship $Ne < N_{IDL}$ to one $Ne \geqq N_{IDL}$. On this occasion, ECU 20 rapidly moves the pulse motor 13 to a predetermined acceleration position (preset position) $PS_{ACC}$, and thereafter initiates the aforementioned air/fuel ratio feedback control. This predetermined position $PS_{ACC}$ is compensated for atmospheric pressure $P_A$, too, as hereinlater described.

The above-mentioned predetermined position $PS_{ACC}$ is set at a position where the amount of detrimental ingredients in the exhaust gas is small. Therefore, particularly at the so-called "standing start," i.e., acceleration from a vehicle-stopping position, setting the pulse motor position to the predetermined position $PS_{ACC}$ is advantageous to antiexhaust measures, as well as to achievement of accurate air/fuel ratio feedback control to be done following the acceleration. Incidentally, the predetermined position $PS_{ACC}$ need not be set at a position at which pulse motor position is obtained a mixture having an air/fuel ratio close to the theoretical value. That is, the predetermined position $PS_{ACC}$ may be set at such a position that the resulting air/fuel ratio is on the lean side of the theoretical value if it is required to reduce the amount of CO and HC in the exhaust gases due to the oxidizing action of the three-way catalyst 38, or it may be set at such a position that the resulting air/fuel ratio is on the rich side if it is required to reduce NOx in the exhaust gases due to the deoxidizing action of the catalyst 38, according to the operating characteristics of the engine concerned. In either case, by setting the pulse motor position to the preset value $PS_{ACC}$ at the standing start of the vehicle, it is possible to reduce the amount of detrimental ingredients in the exhaust gases to be emitted from the engine on such occasion. Further, this setting of the pulse motor position determines the initial air/fuel ratio to be obtained at the start of the air/fuel ratio feedback control operation immediately following the standing start, which enables achieving an air/fuel ratio best appropriate for the emission characteristics and driveability of the engine at the start of the subsequent air/fuel ratio feedback control operation. Particularly, this results in a large reduction in the total amount of detrimental gas ingredients in the exhaust gases emitted from the engine from the standing start to the immediately-following air/fuel ratio feedback control operation, thus being advantageous to the anti-pollution measures.

In transition from the above-mentioned various open loop control to the closed loop control at engine partial load or vice versa, changeover between open loop mode and closed loop mode is effected in the following manner: First, in changing from closed loop mode to open loop mode, ECU 20 moves the pulse motor 13 to an atmospheric pressure-compensated predetermined position $PSi(P_A)$ in a manner referred to later, irrespective of the position at which the pulse motor was located immediately before entering the open loop control. This predetermined position $PSi(P_A)$ includes preset positions $PS_{CR}$, $PS_{WOT}$, $PS_{IDL}$, $PS_{DEC}$ and $PS_{ACC}$, each of which is corrected in response to actual atmospheric pressure as hereinlater referred to. Various open loop control operations can be promptly done, simply by setting the pulse motor to the above-mentioned respective predetermined positions.

On the other hand, in changing from open loop mode to closed loop mode, ECU 20 commands the pulse motor 13 to initiate air/fuel ratio feedback control with I term correction. That is, there can be a difference in timing between the change of the output signal level of the $O_2$ sensor from the high level to the low level or vice versa and the change from the open loop mode to the closed loop mode. In such an event, the deviation of the pulse motor position from the proper position upon entering the closed loop mode, which is due to such timing difference, is much smaller in the case of initiating air/fuel ratio control with I term correction than that in the case of initiating it with P term correction, to make it possible to resume early accurate air/fuel ratio control and accordingly ensure highly stable engine emissions.

To obtain optimum exhaust emission characteristics irrespective of changes in the actual atmospheric pressure during open loop air/fuel ratio control or at the time of shifting from open loop mode to closed loop mode, the position of the pulse motor 13 needs to be compensated for atmospheric pressure. According to the invention, the above-mentioned predetermined or preset positions $PS_{CR}$, $PS_{WOT}$, $PS_{IDL}$, $PS_{DEC}$, $PS_{ACC}$ at which the pulse motor 13 is to be held during the respective open loop control operations are corrected in a linear manner as a function of changes in the atmospheric pressure $P_A$, using the following equation:

$$PSi(P_A) = PSi + (760 - P_A) \times Ci$$

where i represents any one of CR, WOT, IDL, DEC and ACC, accordingly PSi represents any one of $PS_{CR}$, $PS_{WOT}$, $PS_{IDL}$, $PS_{DEC}$ and $PS_{ACC}$ at 1 atmospheric pressure (=760 mmHg), and Ci a correction coefficient, representing any one of $C_{CR}$, $C_{WOT}$, $C_{IDL}$, $C_{DEC}$ and $C_{ACC}$. The values of PSi and Ci are previously stored in ECU 20.

ECU 20 applies to the above equation the coefficients PSi, Ci which are determined at proper different values according to the kinds of open loop control to be carried out, to calculate by the above equation the position $PSi(P_A)$ for the pulse motor 13 to be set at a required kind of open loop control and moves the pulse motor 13 to the calculated position $PSi(P_A)$.

By correcting the air/fuel ratio during open loop control in response to the actual atmospheric pressure in the above-mentioned manner, it is possible to obtain not only conventionally known effects such as best driveability and prevention of burning of the ignition plug in an engine cylinder, but also optimum emission characteristics by setting the value of Ci at a suitable value, since the pulse motor position held during open loop control forms an initial position upon entering subsequent closed loop control.

The position of the pulse motor 13 which is used as the actuator for the air/fuel ratio control valve 9 is monitored by a position counter provided within ECU 20. However, there can occur a disagreement between the counted value of the position counter and the actual position of the pulse motor due to skipping or racing of the pulse motor. In such an event, ECU 20 operates on the counted value of the position counter as if it were the actual position of the pulse motor 13. However, this can impede proper setting of the air/fuel ratio during open loop control where the actual position of the pulse motor 13 must be accurately recognized by ECU 20.

In view of the above disadvantage, according to the air/fuel ratio control system of the invention, as previously mentioned, in addition to detection of the initial position of the pulse motor 13 by regarding as the reference position (e.g., 50th step) the position of the pulse motor at which the reed switch 23 turns on or off when the pulse motor is driven, which was previously noted with reference to the initialization, the position counter has its counted value replaced by the number of steps corresponding to the reference position (e.g., 50 steps) stored in ECU 20 upon the pulse motor 13 passing the switching point of the reed switch 23, to thus ensure high reliability of subsequent air/fuel ratio control.

FIG. 2 is a block diagram illustrating the interior construction of ECU 20 used in the air/fuel ratio control system having the above-mentioned functions according to the invention. In ECU 20, reference numeral 201 designates a circuit for detecting the activation of the $O_2$ sensor 36 in FIG. 1, which is supplied at its input with an output signal V from the $O_2$ sensor. Upon passage of the predetermined period of time Tx after the voltage of the above output signal V has dropped below the predetermined value Vx, the above circuit 201 supplies an activation signal $S_1$ to an activation determining circuit 202. This activation determining circuit 202 is also supplied at its input with an engine coolant temperature signal Tw from from the thermistor 37 in FIG. 1. When supplied with both the above activation signal $S_1$ and the coolant temperature signal Tw indicative of a value exceeding the predetermined value Twx, the activation determining circuit 202 supplies an air/fuel ratio control initiation signal $S_2$ to a PI control circuit 203 to render same ready to operate. Reference numeral 204 represents an air/fuel ratio determining circuit which determines the value of air/fuel ratio of engine exhaust gas, depending upon whether or not the output voltage of the $O_2$ sensor 36 is larger than the predetermined value Vref, to supply a binary signal $S_3$ indicative of the value of air/fuel ratio thus obtained, to the PI control circuit 203. On the other hand, an engine condition detecting circuit 205 is provided in ECU 20, which is supplied with an engine rpm signal Ne from the engine rpm sensor 28, 29, an absolute pressure signal $P_B$ from the pressure sensor 34, an atmospheric pressure $P_A$ from the atmospheric pressure sensor 39, all the sensors being shown in FIG. 1, and the above control initiation signal $S_2$ from the activation determining circuit 202 in FIG. 2, respectively. The circuit 205 supplies a control signal $S_4$ indicative of a value corresponding to the values of the above input signals to the PI control circuit 203. The PI control circuit 203 accordingly supplies to a change-over circuit 209 to be referred to later a pulse motor control signal $S_5$ having a value corresponding to the air/fuel ratio signal $S_3$ from the air/fuel ratio determining circuit 204 and a signal component corresponding to the engine rpm Ne in the control signal $S_4$ supplied from the engine condition detecting circuit 205. The engine condition detecting circuit 205 also supplies to the PI control circuit 203 the above control signal $S_4$ containing a signal component corresponding to the engine rpm Ne, the absolute pressure $P_B$ in the intake manifold, atmospheric pressure $P_A$ and the value of air/fuel ratio control initiation signal $S_2$. When supplied with the above signal component from the engine condition detecting circuit 205, the PI control circuit 203 interrupts its own operation. Upon interruption of the supply of the above signal component to the control circuit 203, a pulse signal $S_5$ is outputted from the circuit 203 to the change-over circuit 209, which signal starts air/fuel ratio control with integral term correction. A preset value register 206 is provided in ECU 20, in which are stored the basic values of preset values $PS_{CR}$, $PS_{WOT}$, $PS_{IDL}$, $PS_{DEC}$ and $PS_{ACC}$ for the pulse motor position, applicable to various engine conditions, and atmospheric pressure correcting coefficients $C_{CR}$, $C_{WOT}$, $C_{IDL}$, $C_{DEC}$ and $C_{ACC}$ for these basic values. The engine condition detecting circuit 205 detects the operating condition of the engine based upon the activation of the $O_2$ sensor and the values of engine rpm Ne, intake manifold absolute pressure $P_B$ and atmospheric pressure $P_A$ to read from the register 206 the basic value of a preset value corresponding to the detected operating condition of the engine and its corresponding correcting coefficient and apply same to an arithmetic circuit 207. The arithmetic circuit 207 performs arithmetic operation responsive to the value of the atmospheric pressure signal $P_A$, using the equation $PSi(P_A)=PSi+(760-P_A)\times Ci$. The resulting preset value is applied to a comparator 210.

On the other hand, a reference position signal processing circuit 208 is provided in ECU 20, which is responsive to the output signal of the reference position detecting device (read switch) 23, indicative of the switching of same, to produce a binary signal $S_6$ having a certain level from the start of the engine until it is detected that the pulse motor reaches the reference position. This binary signal $S_6$ is supplied to the change-over circuit 209 which in turn keeps the control signal $S_5$ from being transmitted from the PI control circuit 203 to a pulse motor driving signal generator 211 as long as it is supplied with this binary signal $S_6$, thus avoiding the interference of the operation of setting the pulse motor to the initial position with the operation of P-term/I-term control. The reference position signal processing circuit 208 also produces a pulse signal $S_7$ in response to the output signal of the reference position detecting device 23, which signal causes the pulse motor 13 to be driven in the step-increasing direction or in the step-decreasing direction so as to detect the reference position of the pulse motor 13. This signal $S_7$ is supplied directly to the pulse motor driving signal generator 211 to cause same to drive the pulse motor 13 until the reference position is detected. The reference position signal processing circuit 208 produces another pulse signal $S_8$ each time the reference position is detected. This pulse signal $S_8$ is supplied to a reference position register 212 in which the value of the reference position (e.g., 50 steps) is stored. This register 212 is responsive to the above signal $S_8$ to apply its stored value to one input terminal of the comparator 210 and to the input of a reversible counter 213. The reversible counter 213 is also supplied with an output pulse signal $S_9$ produced by the pulse motor driving signal generator 211 to count the pulses of the signal $S_9$ corresponding to the actual position of the pulse motor 13. When supplied with the stored value from the reference position register 212, the counter 213 has its counted value replaced by the value of the reference position of the pulse motor.

The counted value thus renewed is applied to the other input terminal of the comparator 210. Since the comparator 210 has its other input terminal supplied with the same pulse motor reference position value, as noted above, no output signal is supplied from the comparator 210 to the pulse motor driving signal generator 211 to thereby hold the pulse motor at the reference position with certainty. Subsequently, when the $O_2$ sensor 36 remains deactivated, an atmospheric pressure-compensated preset value $PS_{CR}(P_A)$ is outputted from the arithmetic circuit 207 to the one input terminal of the comparator 210 which in turn supplies an output signal $S_{10}$ corresponding to the difference between the preset value $PS_{CR}(P_A)$ and a counted value supplied from the reversible counter 213, to the pulse motor driving signal generator 211, to thereby achieve accurate control of the position of the pulse motor 13. Also, when the other open loop control conditions are detected by the engine condition detecting circuit 205, similar operations to that just mentioned above are carried out.

Figure 3:
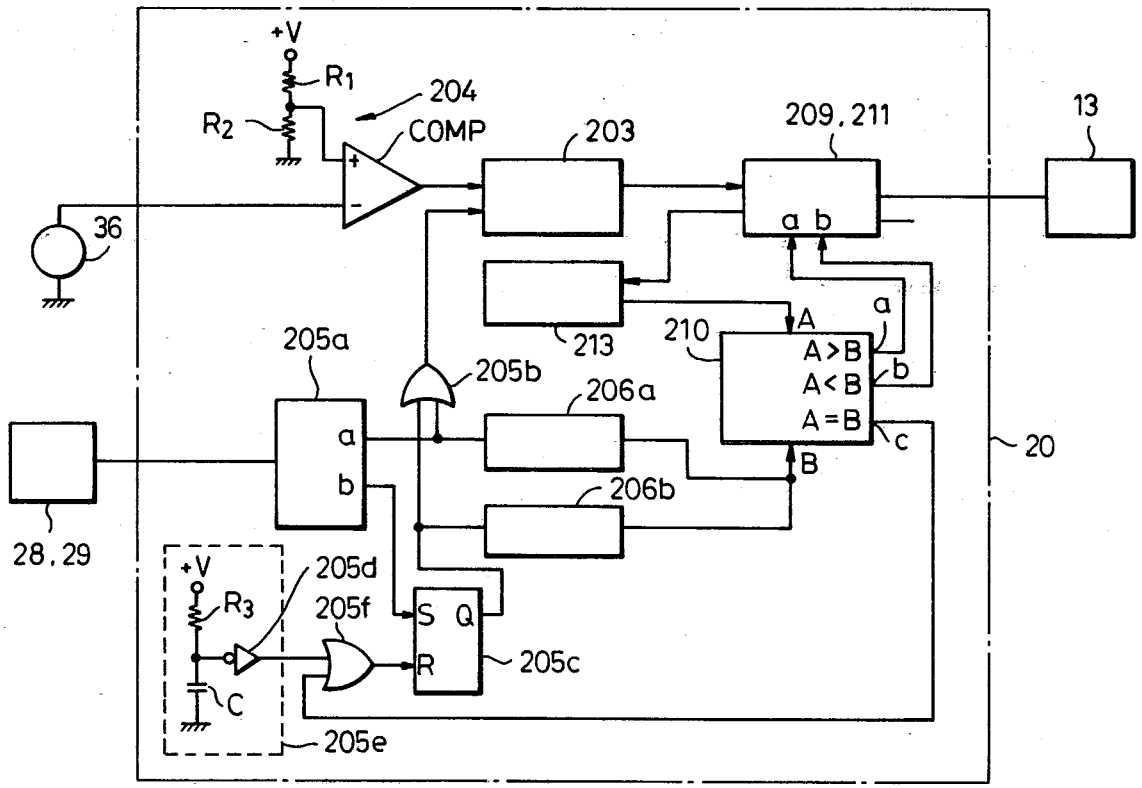
FIG. 3 is a circuit diagram illustrating an acceleration control device for controlling the air/fuel ratio at the standing start of a vehicle associated with the system, according to the invention.

Referring next to FIG. 3, there is shown a block diagram of an acceleration control device provided in the aforedescribed air/fuel ratio control system of the invention for carrying out the air/fuel ratio feedback control operation at the standing start of the vehicle.

The acceleration control device is arranged within ECU 20. The $O_2$ sensor in FIG. 1 is connected to the inverting input terminal of a comparator COMP which in turn has its non-inverting input terminal connected to the junction of a resistance $R_1$ with a resistance $R_2$, the resistance $R_1$, $R_2$ being connected in series between a suitable positive voltage power supply, not shown, and the ground to supply a reference voltage $V_{REF}$ to the comparator COMP. The comparator COMP and the resistances $R_1$, $R_2$ form the air/fuel ratio determining circuit 204 in FIG. 2. The comparator COMP is arranged to supply its output signal to the PI control circuit 203 which in turn is arranged to supply its output signal to the pulse motor driving device 209, 211 which is formed of the change-over circuit 209 and the pulse motor driving signal generator 211, both seen in FIG. 2. The device 209, 211 has its output connected to the pulse motor 13.

On the other hand, the engine rpm sensor 28, 29 is arranged to supply its output to an engine rpm determining circuit **205*a* provided in ECU 20, which forms part of the engine operating condition detecting circuit 205 in FIG. 2. This circuit 205*a* has an output terminal a through which is produced an output when the idle condition of the engine ($Ne<N_{IDL}$) is detected, and an output terminal b through which is produced an output when the acceleration condition of the engine at the standing or off-idle start of the engine ($Ne\geqq N_{IDL}$) is detected. The former terminal a is connected to one input terminal of an OR circuit 205*b* which forms part of the circuit 205 in FIG. 2 and has its output connected to the PI control circuit 203, while the latter terminal b is connected to the S-input terminal of a flip flop 205*c* which forms part of the circuit 205 in FIG. 2, too, and has its output connected to the other input terminal of the OR circuit 205*b*. Connected to the R-input terminal of the flip flop 205*c* via an OR circuit 205*f* is a power resetting circuit 205*e* which is formed of a resistance $R_3$, a capacitor C and a buffer 205*d*** and operable to supply a reset pulse to the above R-input terminal upon turning on the power.

The above circuit **205*a* is arranged to supply outputs through its output terminals a, b to a register 206*a* which forms part of the preset value register 206 in FIG. 2 and stores the value of the predetermined idle positions $PS_{IDL}$, and a register 206*b* which forms part of the register 206, too, and stores the value of the predetermined acceleration position $PS_{ACC}$, respectively, directly and by way of the flip flop 205*c*. These registers 206*a*, 206*b* are arranged to supply their outputs to one input terminal B of the comparator 210 in FIG. 2 which in turn has its other input terminal A connected to the output of the reversible counter 213 in FIG. 2 which is supplied with driving pulses for the pulse motor 13 from the pulse motor driving device 209, 211. The comparator 210 has three output terminals a, b and c, and is adapted to an output through the output terminal a to one input terminal a of the driving device 209, 211 when the number of steps representing the actual position of the pulse motor 13 and supplied to its input terminal A is larger than the number of steps supplied to its input terminal B, and supply an output through its output terminal b to another input terminal b of the device 209, 211 when the number of steps supplied to the terminal A is smaller than the number of steps supplied to the terminal B. When the above two numbers of steps are equal to each other, an output is supplied through the output terminal c of the comparator 210 to the R-input terminal of the flip flop 205***c* via the OR circuit 205*f*.

The operation of the acceleration control device constructed above will now be described. The air/fuel ratio detecting circuit 204 compares the output voltage V of the $O_2$ sensor 36 with the reference voltage $V_{REF}$ supplied thereto through the junction of the resistance $R_1$ with the resistance $R_2$ to supply an output indicative of which of the two inputs is the larger, to the PI control circuit 203. Depending upon this output, the PI control circuit 203 selectively produces control signals to the pulse motor driving device 209, 211 to carry out P term control or I term control.

During the above feedback control, when the engine comes into an idle state, the output of the engine rpm sensor 28, 29 indicative of such idle state causes the rpm determining circuit 205*a* to continuously produce a high level output through its output terminal a during the idle period, which is supplied as a feedback control interrupting signal through the OR circuit 205*b* to the PI control circuit 203 to keep same inoperative. Upon entering the above idle state, the preset value register 206*a* is triggered by the leading edge of the above high level output supplied from the output terminal a of the circuit 205*a* to output a step signal indicative of the value of the predetermined idle position $PS_{IDL}$ to the input terminal B of the comparator 210. The comparator 210 compares this predetermined value signal with a pulse signal indicative of the actual pulse motor position supplied to its input terminal A from the reversible counter 213, to supply its output selectively through its output terminal a or b to the input terminal a or b of the pulse motor driving device 209, 211, depending upon the relationship between the two input signals applied to its input terminals A, B, to cause the device 209, 211 to drive the pulse motor 13 toward the rich side or the lean side. When the pulse motor 13 is driven to a position at which the values of the input signals supplied to the input terminals A, B of the comparator 210 become equal to each other, that is, to the predetermined idle position $PS_{IDL}$, the comparator 210 stops producing its output through its output terminal a or b to cause the device 209, 211 to stop the pulse motor 13.

When the vehicle is accelerated from such an idle state, that is, when the engine rpm Ne increases across the predetermined idle rpm $N_{IDL}$ from an actual rpm at engine idle, the engine rpm determining circuit 205*a* produces an output pulse through its output terminal b and applies it to the S-input terminal of the flip flop 205*c* which in turn supplies a binary output of 1 as a feedback control interrupting signal to the PI control circuit 203 via the OR circuit 205*b* and simultaneously to the preset value register 206*b* to have same to apply a step or pulse signal indicative of the stored value $PC_{ACC}$ to the input terminal B of the comparator 210. In a manner similar to that applied at an engine idle as previously described, the comparator 210 compares this pulse signal with a signal indicative of the actual pulse motor position supplied from the reversible counter 213 to cause the pulse motor driving device 209, 211 to drive the pulse motor 13 to the above predetermined acceleration position $PS_{ACC}$. When the pulse motor 13 is thus set to the preset position $PS_{ACC}$, the values of signals supplied to the input terminals A, B of the comparator 210 are of course equal to each other, so that a binary output of 1 is outputted from the output terminal c of the comparator 210 to the R-input terminal of the flip flop 205*c* via the OR circuit 205*f*. Thus, the output produced at the Q-output terminal of the flip flop 205*c* becomes 0 so that no feedback control interrupting signal is supplied through the OR circuit 205*b* to the PI control circuit 203 which accordingly initiates air/fuel ratio feedback control operation again. This feedback control operation is initiated with an air/fuel ratio corresponding to the predetermined acceleration position $PS_{ACC}$ of the pulse motor 13 as initial air/fuel ratio, thus leading to optimum engine emission characteristics as previously noted. Incidentally, it goes without saying that the arithmetic circuit 207 in FIG. 2 may be added to the arrangement of FIG. 3 to correct the predetermined values $PS_{IDL}$, $PS_{ACC}$ in response to atmospheric pressure.

Figure 4:
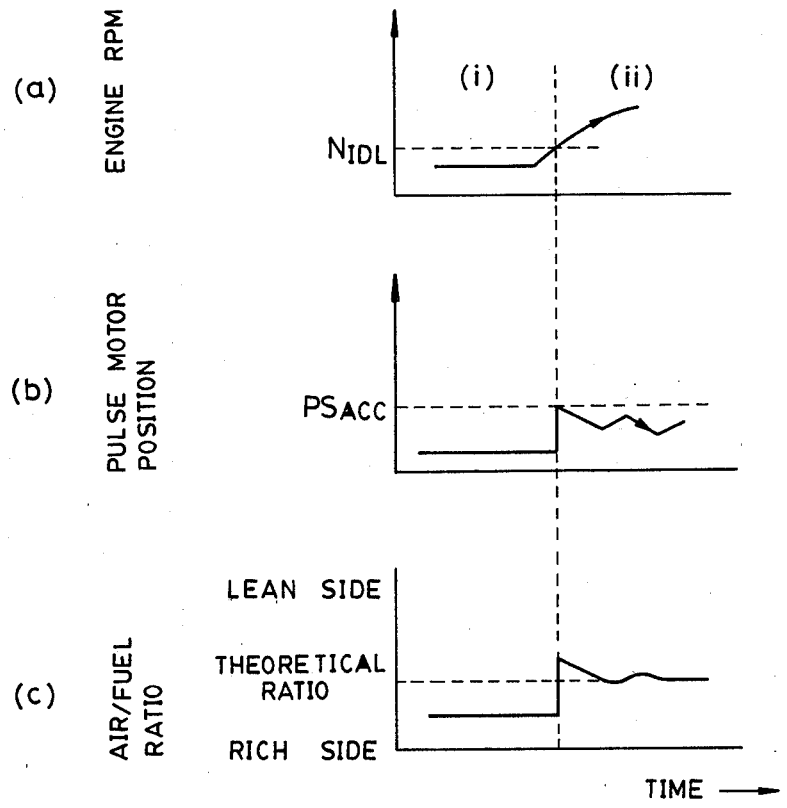
FIG. 4 is a graph showing the relationship between engine rpm, pulse motor position and air/fuel ratio achieved at engine acceleration, all given by way of example.

FIG. 4 shows in graphical representation exemplary changes in the engine rpm, the pulse motor position and the air/fuel ratio obtained at transition from an engine idle state to the air/fuel ratio control at engine acceleration described above. In the graph, indicated at part (i) are characteristics of engine rpm, pulse motor position and air/fuel ratio obtainable at engine idle. In this graph, it is assumed that the pulse motor is positioned at a position smaller in step than the predetermined acceleration position $PS_{ACC}$, and the air/fuel ratio is correspondingly on the rich side. When the engine is accelerated from this idle state shown in part (i) of FIG. 4 (*a*) so that the engine rpm increases across the predetermined idle rpm $N_{IDL}$ which corresponds to the intersection of the vertical break line with the horizontal one, along the line shown in part (ii) of FIG. 4 (*a*), the acceleration control device operates in the aforedescribed manner to move the pulse motor to the predetermined acceleration position $PS_{ACC}$ (FIG. 4 (*b*)) and accordingly the air/fuel ratio is controlled into the lean side (FIG. 4 (*c*)). After this, the PI feedback control operation is initiated, starting with this predetermined acceleration position $PS_{ACC}$ and its corresponding air/fuel ratio as the initial pulse motor position and the initial air/fuel ratio, respectively.

What is claimed is:

1. In an air/fuel ratio control system for performing feedback control of the air/fuel ratio of an air/fuel mixture being supplied to an internal combustion engine, which includes means for detecting the concentration of an exhaust gas ingredient emitted from said engine, fuel quantity adjusting means for producing said mixture being supplied to said engine, and an electrical circuit operatively connecting said concentration detecting means with said fuel quantity adjusting means in a manner effecting feedback control operation in response to an output signal produced by said concentration detecting means to control the air/fuel ratio of said mixture of a preset value, said connecting means including a value having a valve body for varying the air/fuel ratio of said mixture being supplied to said engine, a pulse motor for driving said valve and an electrical circuit for driving said pulse motor in response to said output signal of said concentration detecting means, the combination comprising: means for detecting the rpm of said engine, an acceleration detecting circuit responsive to an output from said engine rpm detecting means for producing a signal indicative of acceleration of said engine when said engine rpm detected by said engine rpm detecting means increases above a predetermined value which is slightly higher than an idle rpm to which said engine is adjusted, means responsive to said acceleration signal to supply driving pulses to said pulse motor so as to cause same to move the valve body of said valve to a preset position which enables to obtain a desired emission characteristic at operation of said engine immediately following said acceleration, means for interrupting the feedback control operation of the air/fuel ratio for a period of time from generation of said acceleration-indicative signal until when said valve moves to said preset position, and means for resuming the feedback control operation of the air/fuel ratio with said preset position of said valve as an initial valve position when said valve moves to said preset position, said acceleration detecting circuit and said driving pulse supply means forming part of said electrical circuit.

2. An air/fuel ratio control system as claimed in claim 1, wherein said preset position for said valve is set such that the mixture being supplied to said engine has an air/fuel ratio leaner than a stoichiometric value.

3. An air/fuel ratio control system as claimed in claim 1, wherein said preset position for said valve is set such that the mixture being supplied to said engine has an air/fuel ratio richer than a stoichiometric value.

* * * * *

UNITED STATES PATENT AND TRADEMARK OFFICE

CERTIFICATE OF CORRECTION

PATENT NO. : 4,401,080

DATED : August 30, 1983

INVENTOR(S) : Kazuo Otsuka, Shin Narasaka, & Shumpei Hasegawa

It is certified that error appears in the above—identified patent and that said Letters Patent is hereby corrected as shown below:

In Claim 1, Column 15, line 2: "mixture of a preset value" should be changed to read -- mixture to a preset value --.

Signed and Sealed this

Sixth Day of March 1984

[SEAL]

*Attest:*

GERALD J. MOSSINGHOFF

*Attesting Officer*

*Commissioner of Patents and Trademarks*